United States Patent [19]

Ekström

[11] 4,297,711

[45] Oct. 27, 1981

[54] OMNIDIRECTIONAL RECEIVING ANTENNA

[76] Inventor: Hans Ekström, Mankkaanpuro 19, SF-02180 Espoo 18, Finland

[21] Appl. No.: 60,368

[22] Filed: Jul. 25, 1979

[30] Foreign Application Priority Data

Jul. 31, 1978 [FI] Finland ..... 782364

[51] Int. Cl.[3] ..... G08B 5/22; G09F 9/00

[52] U.S. Cl. ..... 343/794; 343/800

[58] Field of Search ..... 343/794, 796, 795, 799, 343/800, 802

[56] References Cited

U.S. PATENT DOCUMENTS 2,508,084 5/1950 Alford ..... 343/799

*Primary Examiner*—David K. Moore

*Attorney, Agent, or Firm*—Roylance, Abrams, Berdo & Farley

[57] ABSTRACT

An omnidirectional receiving antenna primarily intended for TV signals and constituted of substantially circular antenna elements, tuned for different TV frequency ranges, connected to an amplifier and cast into a common casing, each antenna element comprising a double dipole antenna, one part of which is of circular shape and made of a metal plate or metal net cut open diametrically from one edge nearly to the opposite edge so as to form a slightly widening slot, and the other part being a metal band or similar extending substantially along the edges of the circular plate or net and at a certain distance therefrom, the ends of the band turning symmetrically inwards at the unbroken edge left by the cut and extending along the edges of the slot and being finally connected to the cut-open edge of the circular part on each side of the slot. Preferably, the antenna comprises several, for example three elements of different diameter and arranged concentrically with and above each others on a common central mast, the elements having a joint amplifier and being cast into a supporting material surrounded by the casing.

7 Claims, 4 Drawing Figures

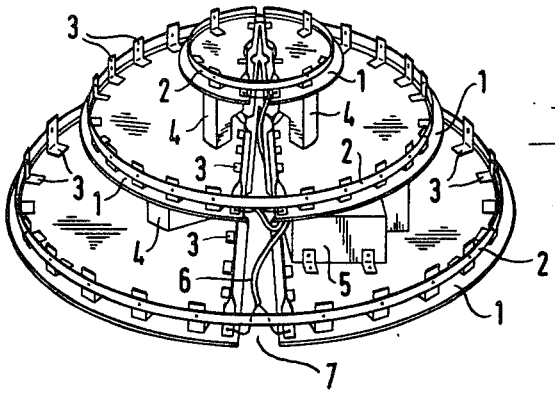
Fig. 1
Fig. 3
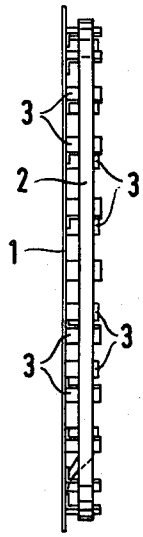
Fig. 2
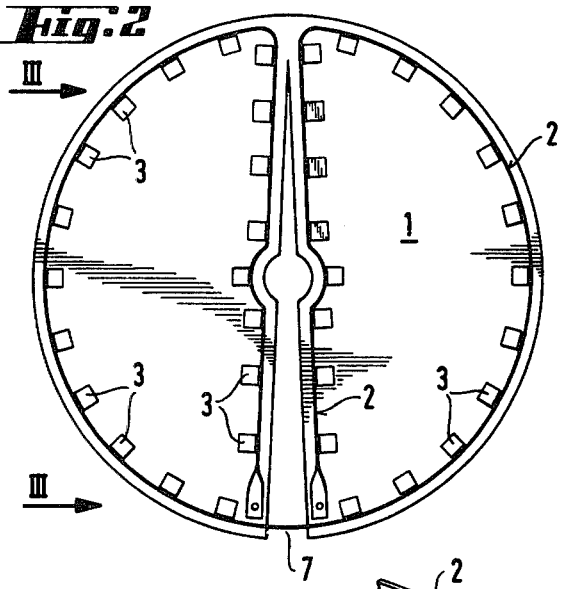
Fig. 4
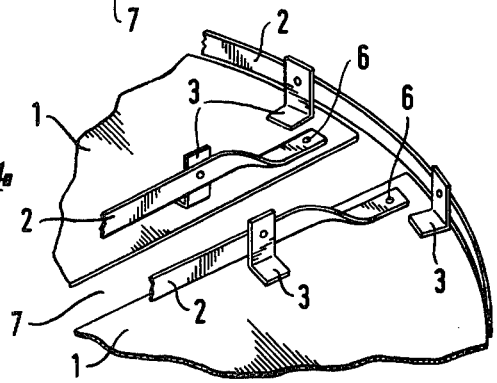

OMNIDIRECTIONAL RECEIVING ANTENNA

BACKGROUND OF THE INVENTION

1. Field of the Invention

The present invention relates to an omnidirectional or around-receiving antenna which has been primarily intended for receiving TV signals and has substantially circular antenna elements preferably tuned for different TV frequency ranges, connected to a joint amplifier, and cast within a common casing.

2. Description of the Prior Art

An antenna of this type is known previously from the Swedish Pat. No. 366,158, for example. In this patent the object is to provide a pleasant-looking antenna which is capable of receiving signals from substantially all directions. Its parts operating within different frequency ranges are circular, open dipoles made of a tube material and always tuned to the average frequency of each frequency range. The circular dipoles have been cast concentrically and spaced apart from each other inside a protective hood by using some foam plastic. The plastic material prevents mutual movement and vibration of the parts. In addition, the dipoles are connected, via symmetrically elements and tuned filters, to a joint wide-band amplifier.

It has been observed that, even though the receiving properties of this prior known antenna are nearly independent of the direction, a weak or "dead" point is formed in its receiving pattern in the direction of the open end of the dipole.

SUMMARY OF THE INVENTION

The present invention provides an antenna of the character once described, which comprises at least one substantially circular antenna element preferably tuned for a certain TV frequency range and consisting of a double dipole antenna, one part of which is a circular plate of metal plate or metal net, cut open from one edge nearly to the other edge, and the other part is a metal band or similar extending substantially along the edges of the plate at a distance therefrom, the ends of the band turning symmetrically inwards at the unbroken edge left by the cut and extending along the edges of the cut on its both sides and being finally connected to the cut-open edge of the plate on both sides of the cut, the antenna further comprising an amplifier to which the connections points are connected and a casing for receiving the antenna element.

Preferably, the antenna is constituted of several, for example three elements of different diameter and tuned for different TV frequency ranges, said elements being arranged concentrically and above each others, cast in a supporting material into a common casing. The elements are suitably connected to a common amplifier, eventually via matching circuits.

It is an object of the present invention to eliminate the disadvantage of weak or dead points involved with the known antenna and to provide an improved antenna having a receiving sector which is practically 360° . Such an antenna is especially suitable for use on ships, for example, since the antenna is small in size, and since in such use it is important that the receiving properties of the antenna do not vary when the ship turns in an arbitrary direction in relation to the transmitter.

BRIEF DESCRIPTION OF THE DRAWING

FIG. 1 depicts a perspective view of an embodiment of the antenna structure according to the invention, without a hood, FIG. 2 depicts a plan view of a part of the antenna, FIG. 3 depicts a side view of a part of the antenna, and FIG. 4 depicts, on a larger scale, a perspective view of a detail of the antenna.

DESCRIPTION OF THE PREFERRED EMBODIMENT

The antenna illustrated in the drawing is mainly intended for use on ships, and it is cast using, for example, polystyrene, inside a bowl-like hood (not shown) as disclosed in, for example, Swedish Pat. No. 366,158 mentioned above. The hood is preferably of plastic material and, of course, at the same time it protects the antenna from the weather.

In the embodiment illustrated, the antenna comprises three elements placed one above the other, the two lowest elements being intended for the VHF range and the highest element being intended for the UHF range. Each element consists substantially of a metal plate or net 1 and a metal band 2 linked to it, as described in more detail below. The elements have been installed, with the aid of intermediate pieces 4, concentrically at distances from each other, the distance being determined partly theoretically and partly experimentally in order to achieve the optimum receiving capacity.

Reference numeral 5 indicates the casing which contains correction circuits and an amplifier and to which the three elements of the antenna have been connected by means of cables 6.

The plate or net 1 which is, for example, aluminium, is circular and cut open 7 along its diameter from one edge nearly to the opposite edge. The shape of the plate of net is best seen in FIG. 2. In the middle it has a round opening for the antenna mast.

The band 2, which can also be aluminum, has been attached by plastic holders 3 to the plate 1 in such a way that it extends along substantially all edges of the plate, as shown in the figures. The ends of the band 2 have been turned down and attached to the plate 1 on both sides of the cut slot 7. These connectors also form the connection of the antenna part further to the amplifier 5.

The plate or net 1 and the band 2 linked to it together constitute a double dipole, and it has been shown by measurements that in this arrangement the dipoles complement each other so that no "dead" sector is formed.

In the embodiment described, in which the antenna consists of three double dipoles, the receiving capacity of the antenna has been observed to improve notably if the polarity of the conductors of the connecting cable 6 of the middle element is reversed in relation to the highest and the lowest ones.

In one example case the following dimensions were given to the elements of an antenna according to the figures:

Plate 1, aluminum, thickness approx. 1 mm, diameters 250, 600 and 830 mm

Band 2, aluminium, thickness approx. 1 mm, width 10 mm

Distance of the band from the plate approx. 20 mm

Distance of the plates from each other 98 mm

Maximum width of the cut approx. 40 mm

Diameter of the central opening 90 mm

What is claimed is:

1. An omnidirectional receiving antenna primarily for receiving TV signals comprising at least one substantially circular antenna element tuned to receive signals in a predetermined frequency range, said at least one element including a substantially circular metal plate having means defining a slot extending along a diameter of the plate, said slot opening at one edge of the plate and extending to a terminus close to but spaced radially inwardly from the opposite edge;

an elongated metal band extending circularly around the periphery of said plate and across the open end of said slot, the end portions of said band being bent inwardly to form substantially straight symmetrical leg portions extending along the edges of said slot from bends therein on opposite sides of the slot opening;

means for connecting the distal ends of said leg portions to said plate adjacent said slot; and means for mounting said band in axially spaced relationship from said plate;

an amplifier having input terminals connected to said end portions of said band; and a housing for said antenna element.

2. An antenna according to claim 1, wherein said slot has an overall shape of a narrow V and has been widened in the middle in order to engage a central mast for supporting the antenna.

3. An antenna according to claim 1, wherein both the circular plate and the metal band are of aluminum plate.

4. An antenna according to claim 1, wherein said means for mounting includes plastic holders.

5. An antenna according to any of claims 1, 2, 3 or 4, comprising a plurality of antenna elements of different sizes for receiving television signals in different frequency ranges, said elements being mounted concentrically at distances from each other in the axial direction, said elements being connected to a common amplifier and cast into a supporting material inside a common housing.

6. An antenna according to claim 5, wherein the connectors of the dipole elements have alternately reversed polarity.

7. An omnidirectional receiving antenna primarily intended for receiving television signals comprising an amplifier; and at least one substantially circular antenna element turned to receive signals in a predetermined frequency range, said at least one element including first and second dipoles formed of material which is electrically conductive in said predetermined frequency range, each of said dipoles being circular in shape with a gap forming a single radial discontinuity in the periphery of said generally circular shape, support means for mechanically fastening said dipoles together in substantially concentric and parallel relationship with the gaps therein facing in substantially opposite directions, said support means being electrically nonconductive in said predetermined frequency range, each of said dipoles having first and second terminals located near the periphery at opposite sides of said gap, and circuit means for electrically interconnecting said terminals so that said dipoles are in parallel circuit relationship and for connecting said parallel circuit to the input of said amplifier.

* * * * *